US005118065A

United States Patent [19]

Becklund et al.

[11] Patent Number: 5,118,065

[45] Date of Patent: Jun. 2, 1992

[54] CLIP

[75] Inventors: Jane K. Becklund, Minnetonka; Jeffrey D. Dahlquist, Ham Lake, both of Minn.

[73] Assignee: Toytech, Inc., Hopkins, Minn.

[21] Appl. No.: 575,491

[22] Filed: Aug. 30, 1990

[51] Int. Cl.[5] ..... A47G 1/10

[52] U.S. Cl. ..... 248/316.5; 248/231.5

[58] Field of Search ..... 248/316.5, 316.7, 692, 248/231.5; 24/299, 265 EC, 343; 489, 508, 492

[56] References Cited

U.S. PATENT DOCUMENTS

| | | | |
|---|---|---|---|
| D. 148,256 | 2/1948 | Fauteux, Jr. | D17/6 |
| D. 170,544 | 10/1952 | Nalle, Jr. | D80/8 |
| D. 175,169 | 7/1955 | Jacobson | D80/8 |
| D. 187,643 | 4/1960 | Sigman | D17/3 |
| D. 295,811 | 5/1988 | Larsson | D6/326 |
| D. 297,285 | 8/1988 | Larsson | D6/326 |
| 148,088 | 3/1874 | Reid et al. . | |
| 623,027 | 4/1899 | Mills, Jr. . | |
| 1,874,871 | 8/1932 | Bower | 24/343 X |
| 2,038,043 | 4/1936 | Hasselblad | 248/316.5 |
| 2,506,783 | 5/1950 | Fauteux, Jr. | 24/84 |
| 2,644,210 | 7/1953 | McNamee | 24/565 X |
| 3,041,696 | 7/1962 | Ferri, Jr. | 24/137 |
| 3,060,536 | 10/1962 | Voie | 24/237 |
| 3,100,324 | 8/1963 | Tutino et al. | 24/137 |
| 3,135,034 | 6/1964 | Fauteux | 24/489 X |
| 3,349,453 | 10/1967 | Iida et al. | 24/489 |
| 3,355,030 | 11/1967 | Cathcart | 211/87 |
| 4,277,863 | 7/1981 | Faneuf | 34/3 |
| 4,317,522 | 3/1982 | Garrett | 211/113 |
| 4,566,157 | 1/1986 | Packendorff | 24/536 |
| 4,592,472 | 6/1986 | Carnera | 211/119 |
| 4,690,288 | 9/1987 | Mitchell | 211/113 |
| 4,987,660 | 1/1991 | Saguccio | 24/489 X |

FOREIGN PATENT DOCUMENTS

| | | | |
|---|---|---|---|
| 0023211 | of 1907 | United Kingdom | 248/316.5 |

OTHER PUBLICATIONS

Brochure, "The Chain Gang Organizer", 3 pages including one two-sided brochure, one page of two photographs and one page of hand sketches of the pivot portion.

"Brochure entitled New Tidy Chain Teddy Tidy", one page, 1989.

*Primary Examiner*—Ramon O. Ramirez

*Attorney, Agent, or Firm*—Palmatier & Sjoquist

[57] ABSTRACT

A hanger with a suspended chain and clips thereon for supporting articles such as toys and small clothing articles, the clips having rigid hooks on one of the jaw-arms, the hooks being connected with the sides of several links and the hooks bearing against the end of the link next below so as to be held transversely out to the side; the clips having a spring with in-turned hook shaped ends to grasp panel portions and restrict relative endways movement of the jaw-arms; and the pivot structure including fulcrum hubs with projecting teeth and notches, both with confronting flat retaining surfaces restricting any tendency of the jaw-arms to move endways relative to each other.

22 Claims, 5 Drawing Sheets

CLIP

BACKGROUND OF THE INVENTION

Hangers for storing soft toys, dolls, and articles of clothing have been previously known. Some have utilized vertically suspended chains with fasteners attached thereto. An example is illustrated in U.S. Pat. No. 4,690,288 and utilizes a one-piece, large looped plastic fastener extending through a chain link. Other one-piece clips to be suspended from a horizontal clothesline are shown in U.S. Pat. Nos. 3,100,324 and 4,566,157.

Still other forms of multi-part clips are shown in U.S. Pat. Nos. 3,060,536; 3,349,453; 3,041,696 and 2,506,783. A clothes hanger on a horizontal chain serving a clothesline is illustrated in U.S. Pat. No. 4,592,472.

A prior commercial form of hanger has a plastic chain vertically suspended and carrying a number of clips attached loosely to the chain links by separate nylon straps. A hole in the handle of the clip accommodates the strap. This loose arrangement allows the clip to hang downwardly against the chain. Such clips are prone to inadvertent disassembly at the pivot.

SUMMARY OF THE INVENTION

An object of the invention is to provide a convenient hanger for toys, mittens, scarves and clothes as to allow any and all such items to be hung together, but separated to permit airing, drying and convenient access to such items.

Another object of the invention is to provide a clip for suspending articles and which is readily an easily attached to and detached from links of a chain without the use of tools.

Still another object of the invention is to provide a clip which is easily manufactured and which is sturdy in assembly to prevent unintended separation of the two clip jaw-arms from each other.

A feature of the invention is a hanger incorporating a link chain that may be hung from an elevated support, and a plurality of clips with jaws for suspending various articles, each clip having a hook formed on the end of one arm to hang from a link of the chain. The hook at the end of the arm defines an open slot or access passage which is smaller than the thickness of the chain link to require deformation of the hook during assembly or disassembly with the chain link. The hook is substantially rigid with the arm of the clip, and as the hook grasps one link of the chain, the hook rests upon the next lower chain link, thereby orienting the clip transversely outwardly of the chain when the chain is suspended. In some circumstances, the chain link might be open, as to allow the hook on the clip to be closed, but with conventional chains, the hook on the clip is open to slip onto the chain link. Drying and airing of, and access to the items suspended by the clips, is significantly enhanced.

Another feature of the invention is a plastic molded clip wherein the two jaw-arms have pivot hubs with partially cylindrical peripheries bearing against each other. On each of the pivot hubs is a pair of lugs or teeth projecting generally radially outward and a pair of lug receiving notches or recesses formed inwardly of the hub periphery. The recesses are shaped so that in each recess the mating lug may swing or oscillate therein, as the pivot lugs roll or oscillate on each other during opening and closing of the jaws. The recesses and lugs have confronting surfaces to abut each other when the jaws are both open and closed to prevent relative endways movement of the two jaw-arms and accordingly prevent accidental disassembly. The simple U-shaped spring which urges the jaws together are provided with in-turned ends which grip portions of the jaw-arms and together with the lugs on the pivot hubs restrain endways movement of the jaw-arms.

DETAILED SPECIFICATION

Figure 1:
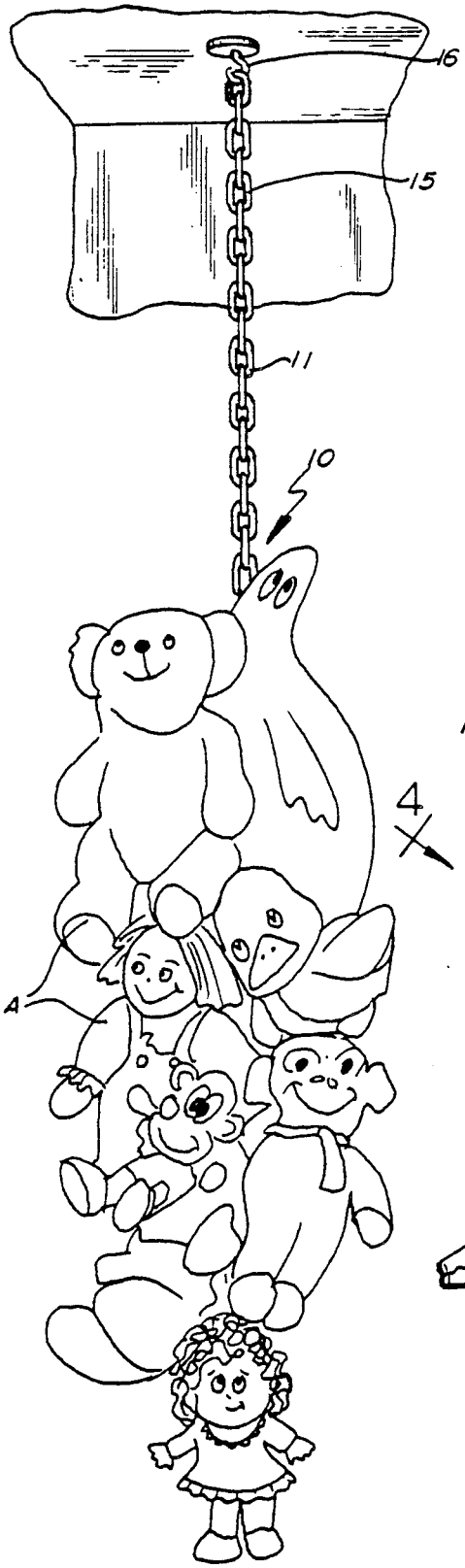
FIG. 1 is a general perspective view showing use of the invention.

One form of the invention is shown in the drawings and is described herein. The hanger is indicated in general by numeral 10 and includes a chain 11 formed of a multiplicity of plastic molded links 12 which are elongate in shape. The sides 13 of the links are elongate and the ends 14 of the links are supported on each other. The upper portion 15 of the chain is supported from an elevated fixture such as a hook 16 in the ceiling of a room, and the lower portion 17 of the chain will hang downwardly, near the floor of a room.

Figure 2:
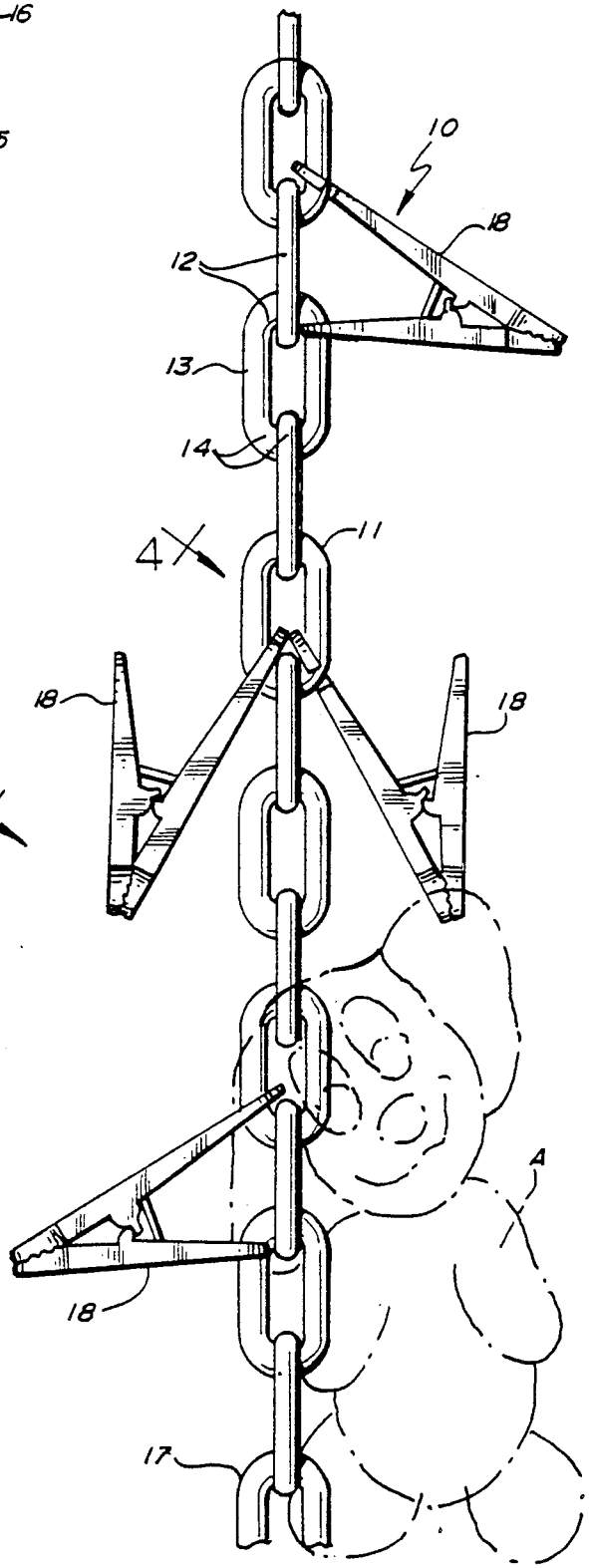
FIG. 2 is a detailed elevation view of the invention with a suspended article illustrated in dotted lines.

The chain 11 carries a multiplicity of clips 18, for supporting a multiplicity of articles A, seen in FIGS. 1 and 2, which may be any of a number of types of articles, such as dolls, soft toys, mittens, scarves, etc. It will be understood that the weight of the clips 18 and the lower portion 17 of the chain will produce a certain tension in the chain, tending to keep the elongate links 12 in substantial alignment with each other due to the tension. Of course, when articles A are attached to the clips, the tension on the chain is increased, so as to minimize the possibility of any of the links 12 being out of alignment with each other. The elongate sides 13 and the looped ends 14 of the links are substantially uniform in thickness; and the opening in each of the links is much longer by several multiples than the width of the opening.

Each of the clips 18 is made up of a pair of jaw-arms 19 and 20, and a generally U-shaped spring 21. The jaw-arms 19 and 20 are molded of substantially rigid plastic and have jaws 22, 23 formed at their outer end portions to form article attaching means for gripping such an article A as illustrated in FIGS. 1 and 2. The jaw-arms 19 and 20 also have substantially rigid handles 24, 25 at their inner end portions. The handle 25 of jaw-arm 20 also provides a substantially rigid mounting arm for a hook or open loop 26 which is formed integrally of and is rigid with the handle 25. Although the hook 26 lies in a plane and is substantially rigid, it is resiliently yieldable to the degree necessary as to allow the terminal end portion 27 of the hook to be deformed out of the plane of the hook for the purpose of attaching the hook 26 to one of the links 12 of the chain or for removing the hook from the chain.

Apart from the jaw-arm 20 having the hook 26 rigidly secured as a part of handle 25, the two jaw-arms 19 and 20 are substantially identical and are mirror images of each other so that the corrugations in the faces of the jaws 22, 23 fit together and nest into each other for securely gripping the articles A to be supported. The hook 26 defines an elongate loop opening 28, one end of which has an entrance passage 29, the width of which is narrower than the width of the loop opening 28 and is also narrower than the thickness of the chain links 12, and particularly the side portions 13 thereof. The loop opening 28 has a width which is substantially the same as the thickness of the links 12 of the chain at the side portions 13 thereof so that the side portions 13 of the chain will fit closely into the loop opening 29 without permitting significant side-to-side movement, while at the same time the loop 28 will allow the clip 18 to readily slide along the side portion 13 of the chain link.

The hooks 26 have transverse support and engaging portions 30 adjacent the ends of the loop opening 28 for engaging the inner portion of the chain link 12, particularly at the elongate inner side 13 thereof.

Figure 5:
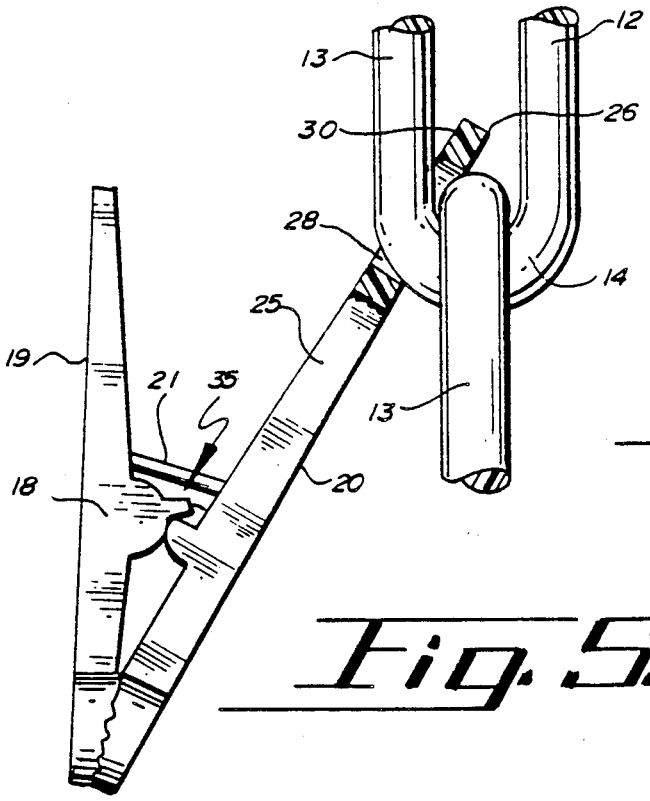
FIG. 5 is an enlarged detailed elevation view of one of the clips shown partially in section for clarity of detail.

When the clips 18 are mounted on the chain links at their hooks 26, as illustrated in FIGS. 2 and 5, the clips will extend transversely out to the side as a result of the rigid hooks 26 engaging the side portions 13 of the chain link as the rigid handle or mounting member 25 lies upon the end portion of the link below that which the clip is attached. The tension on the chain maintains the links in linear condition with respect to each other and the clips are held out to the side as illustrated in the drawing. Certain of the clips, such as those illustrated at the top and bottom of FIG. 2, are also assisted in being oriented out to the side, or transversely of the chain, by the shorter jaw-arm 19 wherein the handle portion 24 will bear against a portion of the chain in addition to the fact that the hook bears against the side portion 13 of the chain link and rests upon the end portion 14 of the chain link next below that which the hook is attached to. As a result, the articles supported by the jaws of the clips are held somewhat away from each other so that air may circulate and any dampness in the articles will readily be dried.

Figure 11:
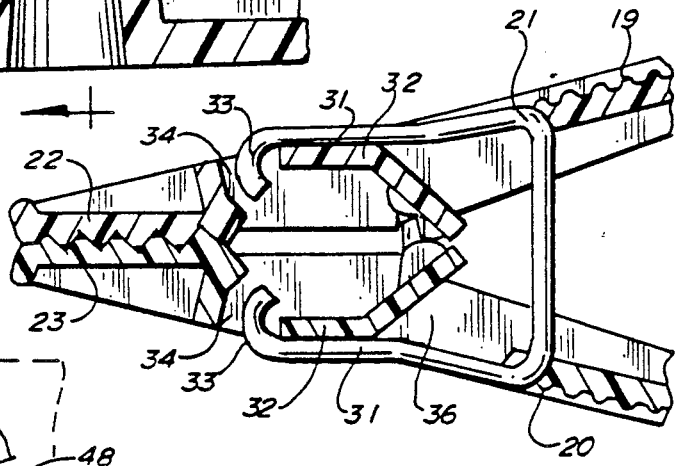
FIG. 11 is a detailed section view taken at approximately 11—11 of FIG. 4.
Figure 10:
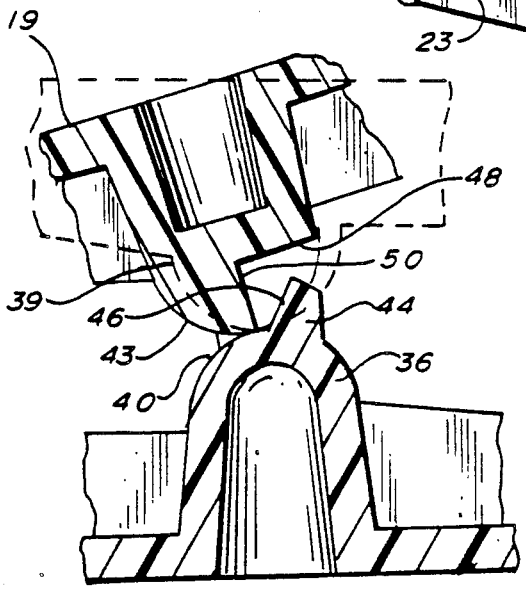
FIG. 10 is an enlarged detailed section view taken approximately at 10—10 of FIG. 8.
Figure 12:
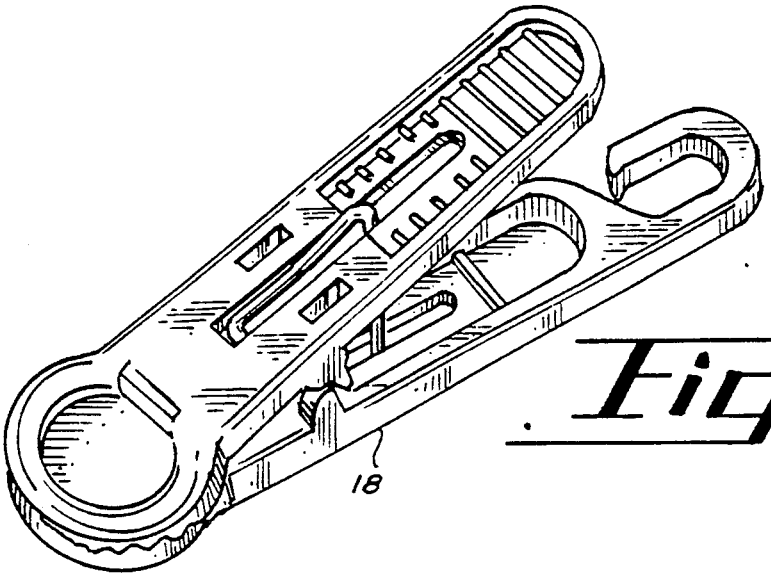
FIG. 12 is a perspective view of the clip and illustrating the side opposite to that seen in FIG. 3.
Figure 13:
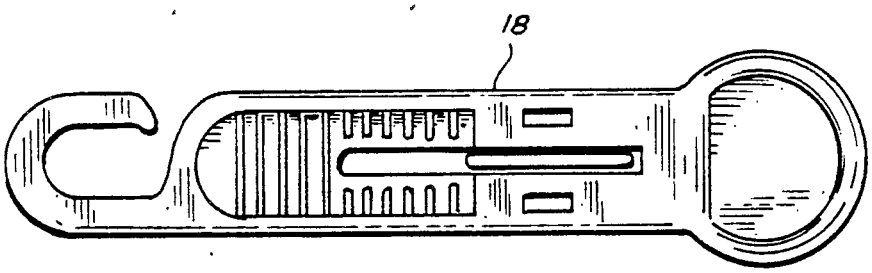
FIG. 13 is a bottom plan view of the clip.

The jaw-arms 19 and 20 are retained against each other by the spring 21 as seen clearly in FIG. 11. The spring is generally U-shaped and has elongate leg portions 31 which lie along panels 32 of the jaw-arms 19 and 20. The end portions 33 of the leg portions 31 of the spring 21 are hook shaped and extend inwardly into openings 34 of the jaw-arms 19, 20 and to grip the end edges of the panels 32.

Because of the inwardly turned hook portions 33 of the spring 21 which interlock with the panels 32 of the jaw-arms, the spring restrains any relative endways movement of the elongate jaw-arms relative to each other, and accordingly, the spring restrains unintended disassembly of the clip. As a result, the articles A being held by the jaws 22, 23 will be securely held without being unintentionally dropped.

Figure 3:
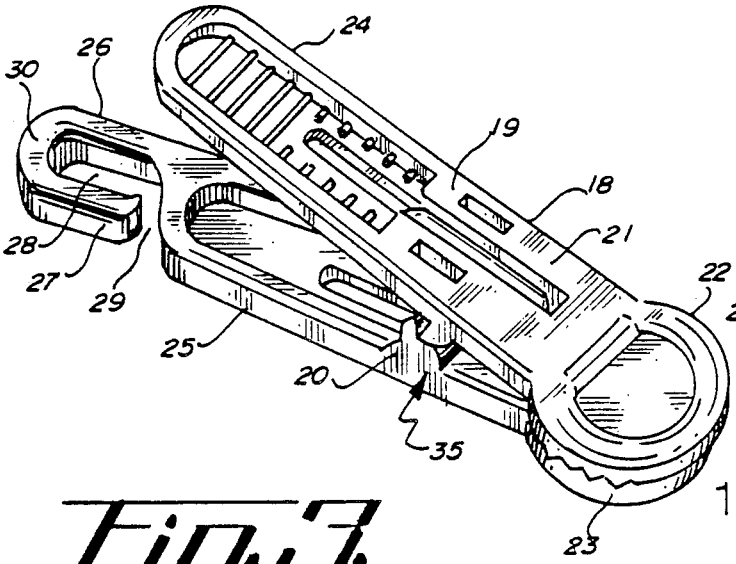
FIG. 3 is a perspective view of one of the clips used in the invention.
Figure 4:
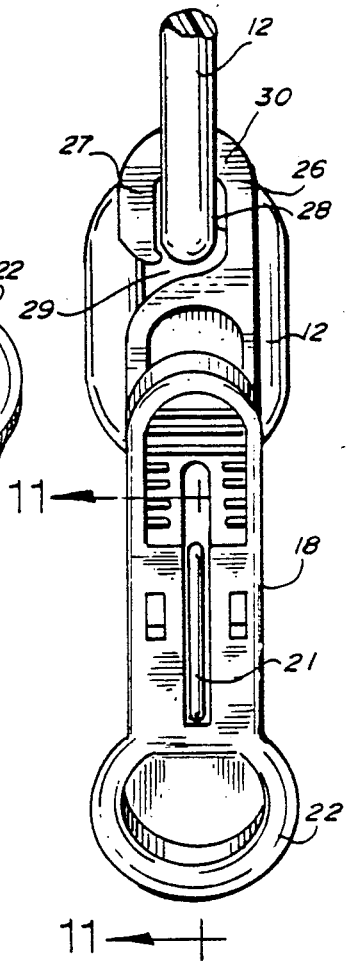
FIG. 4 is an elevation view of a clip.
Figure 6:
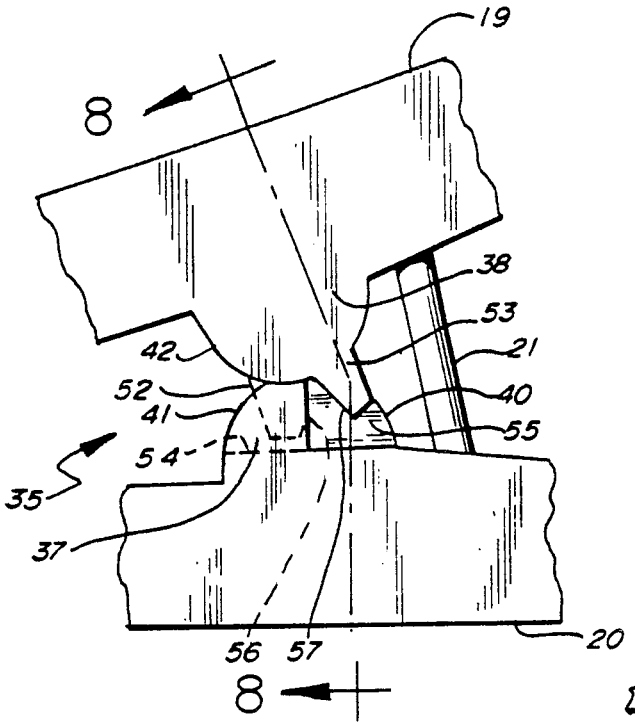
FIG. 6 is an enlarged detailed elevation view of the pivot portion of one of the clips.
Figure 7:
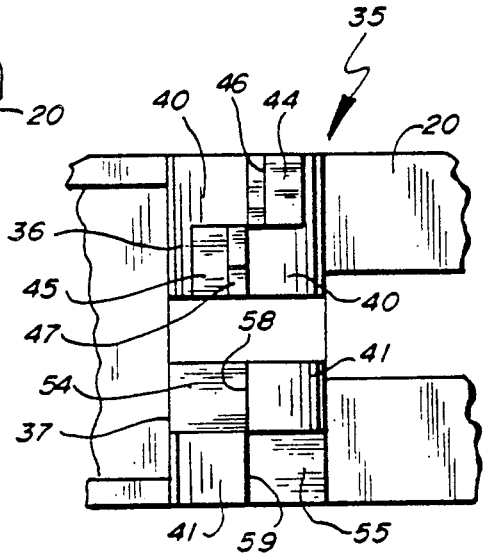
FIG. 7 is a detailed plan view of one of the jaw-arms of the clip and illustrating the pivot portion thereof.
Figure 8:
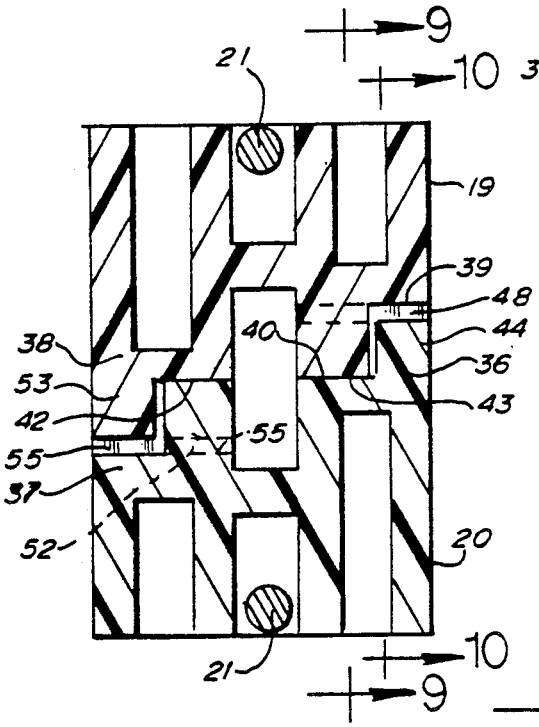
FIG. 8 is a detailed section view taken approximately at 8—8 of FIG. 6 and illustrating the assembled pivot portion of the clip.
Figure 9:
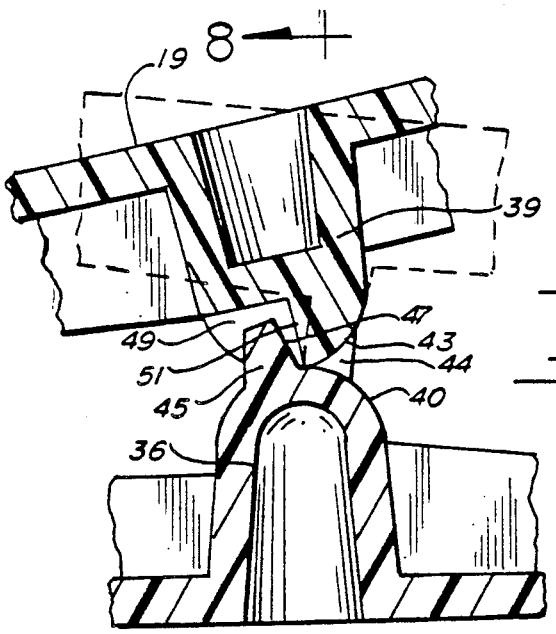
FIG. 9 is an enlarged detailed section view taken approximately at 9—9 of FIG. 8.

The pivot portion 35 of the clip 18 is also constructed to restrain unintended disassembly of the clip and unintended relative endways movement of the two jaw-arms 19, 20. The pivot portions 35 of the two jaw-arms 19, 20 are identical with each other so that when the jaw-arms are assembled with each other into the clip 18 as illustrated in FIGS. 3, 5 and 6, the pivot portions 35 interfit with each other.

The jaw-arm 20 has a pair of fulcrum hubs 36, 37; and the jaw-arm 19 also has a pair of fulcrum hubs 38, 39. Each of the fulcrum hubs 36–39 has rounded and partially cylindrical bearing surfaces 40–43 to accommodate tilting oscillation of the two jaw-arms 19, 20 relative to each other. For this purpose, the bearing surfaces 40 and 43 bear against each other and rock upon each other, and the bearing surfaces 41 and 42 bear against each other and rock upon each other.

The fulcrum hub 36 of the jaw-arm 20 has a pair of side-by-side, but diverging teeth 44, 45 which have flat retaining surfaces 46, 47 facing in opposite directions, endways of the elongate jaw-arm 20. The teeth 44, 45 fit into notches 48, 49 in fulcrum hub 39 of jaw-arm 19. The fulcrum hub 39 defines flat retaining surfaces 50, 51 at notches 48, 49 respectively and facing in opposite directions endways of the jaw-arm 19. The flat faces 51 and 47 confront each other, and the faces 46 and 50 confront each other to engage each other in the event of any relative endways movement of the jaw-arms to restrict the relative endways movement of the jaw-arms.

The fulcrum hub 38 of jaw-arm 19 also has a pair of side-by-side and relatively divering retaining teeth 52, 53 projecting therefrom and into notches 54, 55 respectively in fulcrum hub 37.

The retaining teeth 53, 54 have flat retaining surfaces 56, 57 confronting flat retaining surfaces 58, 59 in the fulcrum hub 37 adjacent notches 54, 55. The teeth 52, 53 are retained by the flat retainer surfaces 56, 57 against movement in either endways direction relative to the elongate jaw-arms 19. It will be recognized that the two sets of side-by-side teeth 44, 45 and 52, 53 are identical with each other and are clustered across the width of the two jaw-arms in corresponding notches.

The diverging relation of side-by-side teeth on the fulcrum hubs 36 and 38 allows the jaw-arms to oscillate or tilt with respect to each other as they turn on the bearing surfaces 40, 41, 42 and 43 while the retaining surfaces continue to confront each other and restrict any relative endways movement of the jaw-arms relative to each other. As a result, the clip 18 will not be inadvertently disassembled when the articles are being carried thereby.

The present invention may be embodied in other specific forms without departing from the spirit or essential attribtes thereof; therefore, the illustrated embodiment should be considered in all respects as illustrataive and not restrictive, reference being made to the appended claims rather than to the foregoing description to indicate the scope of the invention.

I claim:

1. A hanger for suspending articles such as toys, mittens, and scarves, comprising a suspended chain comprising upper and lower portions and a multiplicity of links connected together, and an elongate clip with inner and outer end portions and having an article attaching means at the outer end portion, the clip also having a mounting arm with a hook portion formed on the inner end portion and being rigid with the mounting arm, the hook portion comprising an elongate loop opening receiving a portion of a link of the chain, the hook portion engaging the chain link adjacent the loop opening to orient the elongate clip transversely of the chain.

2. A hanger according to claim 1 wherein said hook portion of the mounting arm has support portions adjacent both ends of the elongate loop opening and engaging adjacent portions of the chain.

3. A hanger according to with claim 1 wherein said hook portion also engages and rests upon the next adjacent chain link therebelow to hold the elongate clip outwardly to the side of the chain.

4. A hanger according to claim 1 wherein the chain has additional clips spaced from each other on the chain and producing tension on the links to stiffen the chain and to cause the clips to protrude transversely outwardly of the chain.

5. A hanger according to claim 1 wherein the hook portion comprises an entrance passage into the loop opening for assembling a portion of the chain link into the loop opening, the entrance passage being narrower than the thickness of said portion of the chain link.

6. A hanger according to claim 1 wherein the elongate loop opening is longer than the thickness of said portion of the chain link.

7. A hanger according to claim 1 wherein said elongate clip comprises a pair of elongate jaw-arms, and said mounting arm being rigid with one of said jaw-arms.

8. A hanger according to claim 1 wherein said hook portion lies substantially in a plane, the hook portion being resiliently yieldable to deflect out of the plane for alternately removing and receiving said portion of the chain link.

9. A hanger clip to suspend articles such as toys, mittens, and scarves, comprising a pair of elongate jaw-arms lying along each other and having cooperating article gripping jaw portions and slotted handle portions, the jaw-arms having pivot portions intermediate the jaw portions and handle portions and having panel portions adjacent the jaw portions, and said pivot portions accommodating rocking oscillation of the jaw-arms relative to each other, and a retainer spring portion traversing said pivot portions and protruding through said slotted handle portions, and said spring portions having elongate legs lying longitudinally along said jaw-arms, the spring portion having end portions being inturned toward each other and engaging said panel portions of the jaw-arms to engage and retain said jaw-arms against endways relative movement therebetween.

10. A hanger according to claim 1 wherein the elongate loop opening has a width substantially the same as the thickness of said portion of the link of the chain but with sufficient width as to be freely slidable along the portion of the link, and said loop opening having a length substantially greater than the thickness of said portion of the link.

11. A hanger according to claim 1 wherein the links of the chain are elongate, and said portion of the link is elongate.

12. A hanger for suspending articles such as toys, mittens, and scarves, comprising a chain with a multiplicity of links connected together, a portion of the chain being intermediate the ends of the chain, and a clip with inner and outer end portions and having an article attaching means at the outer end portion, the clip also having a mounting arm with a loop portion on the inner end portion, the loop portion being rigid with the mounting arm and embracing a portion of a link of the chain, the clip extending transversely of the chain.

13. A hanger according the claim 12 wherein said portion of the chain is suspended, the loop portion of the mounting arm embracing a portion of a link in said suspended portion of the chain and resting upon the next adjacent link therebelow.

14. A hanger clip to suspend articles such as toys, mittens, and scarves, comprising a pair of elongate jaw-arms lying along each other and having cooperating article gripping jaw portions and handle portions, resilient retaining means holding the jaw-arms together and resiliently urging the jaw portions toward each other, and the jaw-arms having pivot portions intermediate the jaw portions and handle portions, the pivot portion of the jaw-arms comprising fulcrum hub portions projecting toward each other, each fulcrum hub portion comprising a rounded bearing surface portion engaging the bearing surface portion of the fulcrum hub portions of the other jaw arm to tiltably oscillate thereon, said fulcrum hub portion having projecting teeth and teeth receiving notches shaped to permit oscillation of the teeth therein and preventing relative endways movement of the jaw-arms.

15. A clip according to claim 14 wherein the bearing surface portions are partially cylindrically rounded and said teeth and notches have substantially flat surface portions facing endways of the jaw-arms, the flat surface portions of the teeth and notches bearing against each other to prevent such relative endways movement between the jaw-arms.

16. A clip according to claim 14 wherein each of the fulcrum hub portions have a pair of side-by-side teeth and a pair of side-by-side notches receiving the side-by-side teeth of the other fulcrum hub portion, said pairs of teeth diverging relative to each other from the hub portions.

17. A clip according to claim 14 wherein the fulcrum hub portion of each jaw-arm comprise a pair of retaining surfaces in said notches and facing in opposite directions endways of the jaw-arm, and also comprising a pair of retaining surfaces on said teeth and facing in opposite directions endways of the jaw-arm, all of said bearing surfaces being adjacent to each other and arranged across the width of the jaw-arm and confronting oppositely facing surfaces of the other jaw-arm.

18. A clip according to claim 17 wherein on each of the jaw-arms the teeth are clustered together in side-by-side relation and the notches are also clustered together in side-by-side relation.

19. A clip according to claim 14 wherein the projecting teeth and teeth receiving notches are also shaped to prevent relative transverse movement of the elongate jaw arms.

20. A clip according to claim 14 wherein said retaining means comprises a spring means with elongate retainer portions bearing against the jaw arms and urging the jaw portions toward each other. and said retainer portions having inwardly bent hook portions gripping projecting portions of the jaw-arms and restraining endways movement of the jaw-arms.

21. A clip according to claim 14 wherein the handle portion of one of said jaw-arms has mounting means thereon from which the jaw-arms and such articles are suspended.

22. A clip according to claim 21 wherein a suspended chain comprises links to which said mounting means is attached.

* * * * *